US010809031B2

(12) United States Patent
Geissele et al.

(10) Patent No.: US 10,809,031 B2
(45) Date of Patent: Oct. 20, 2020

(54) LINEAR TRIGGER MECHANISMS FOR FIREARMS

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/131,840

(22) Filed: Sep. 14, 2018

(65) Prior Publication Data

US 2020/0088486 A1 Mar. 19, 2020

(51) Int. Cl.
*F41A 19/43* (2006.01)
*F41A 19/10* (2006.01)

(52) U.S. Cl.
CPC ..... *F41A 19/43* (2013.01); *F41A 19/10* (2013.01)

(58) Field of Classification Search
CPC ..... F41A 19/43; F41A 19/10; F41A 19/00; F41A 19/12; F41A 19/14; F41A 19/15; F41A 19/16; F41A 19/17; F41A 19/42; F41A 19/44; F41A 19/45; F41A 19/46
USPC ..... 42/69.03
See application file for complete search history.

(56) References Cited

U.S. PATENT DOCUMENTS 4,421,009 A * 12/1983 Castellano ..... F41A 19/33 89/140
4,463,654 A * 8/1984 Barnes ..... F41A 19/09 42/74
4,522,105 A * 6/1985 Atchisson ..... F41A 19/44 42/69.03
4,892,026 A * 1/1990 Aigner ..... F41A 19/46 89/140
4,938,116 A * 7/1990 Royster ..... F41A 3/82 89/198
5,164,534 A * 11/1992 Royster ..... F41A 3/80 89/1.4
5,299,374 A * 4/1994 Mathys ..... F41A 19/10 42/69.01
2006/0101693 A1* 5/2006 Langlotz ..... F41A 19/16 42/69.01
2016/0377363 A1* 12/2016 Lipowski ..... F41A 19/10 42/69.01

FOREIGN PATENT DOCUMENTS

WO WO-2014105534 A2 * 7/2014 ..... F41A 19/10

* cited by examiner

*Primary Examiner* — John Cooper
(74) *Attorney, Agent, or Firm* — Fox Rothschild LLP

(57) ABSTRACT

Linear trigger mechanisms for firearms include a trigger slide mounted on, and configured to move linearly in relation to a chassis; and a hammer. The trigger slide has a rolling element, such as a pin-mounted roller or a rolling pin, that engages a contact surface on the hammer and thereby restrains the hammer against its spring bias. When the user pulls the trigger to discharge the firearm, the trigger slide moves linearly, causing the rolling element to roll off of the contact surface and thereby release the hammer. The trigger mechanisms can be equipped with a drop safety that rotates in response to an impact between the firearm and the ground, so as to interfere with the movement of the trigger slide and prevent the release of the hammer.

20 Claims, 13 Drawing Sheets

LINEAR TRIGGER MECHANISMS FOR FIREARMS

FIELD

The inventive concepts disclosed herein relate to firearms having trigger mechanisms that are actuated by linear movement of a trigger.

BACKGROUND

Firearms such as rifles and handguns normally include some type of trigger mechanism by which the user discharges the firearm. Trigger mechanisms typically include a spring-loaded hammer having a striking surface configured to strike a firing pin of the firearm. The firing pin transfers the impact from the hammer to a cartridge positioned in a chamber of the firearm. The impact causes a primer of the cartridge to ignite a propellant within the cartridge. The expanding propellant drives a projectile from a casing of the cartridge and through a barrel of the firearm so that the projectile exits the barrel at a high velocity.

Prior to initiation of the firing sequence, the hammer is held in a pre-firing position in which its striking surface is spaced apart from the firing pin. The hammer is restrained in the pre-firing positon, against its spring bias, by a trigger sear. The trigger sear and the hammer are configured so that at least one surface of the trigger sear contacts at least one corresponding surface on the hammer, in a manner that interferes with the movement of the hammer toward the firing pin. Pulling the trigger of the trigger mechanism causes the trigger sear to move in a manner that causes its contact surface to disengage from a corresponding contact surface of the hammer, which in turn releases the hammer and allows the hammer to rotate toward and strike the firing pin.

The interface between the hammer and the trigger sear affects the trigger pull weight (i.e., the amount of force that needs to be exerted on the trigger to release the hammer) and the smoothness with which the trigger can be pulled. In some instances, a high trigger pull weight can be problematic. For example, high trigger pull weight can result in fatigue or injury to the user, can limit the accuracy of the firearm, and can cause excessive wear of the trigger mechanism. A rough or uneven trigger pull can also limit the accuracy of the firearm.

Trigger pull weight can be reduced, and the smoothness of the trigger pull can be improved, by reducing the respective sizes of the contacting surfaces on the hammer and the trigger sear. Such reductions in the contact areas, however, can create other problems by increasing the potential for the surfaces to become disengaged unintentionally, such as when the firearm is dropped. Accidental discharge of a dropped firearm poses a significant risk that can result in serious injury or even death. Thus, due to the tradeoff between low trigger pull weight and smooth trigger pull on the one hand, and safety from accidental discharge on the other, many types of firearms have either an excessive trigger pull weight and a rough, uneven trigger pull; or insufficient protection against accidental discharge.

SUMMARY

The present disclosure relates generally to trigger mechanisms that are actuated by linear movement of a trigger.

In one aspect, the disclosed technology relates to a trigger mechanism for a firearm, the trigger mechanism including:

a chassis; a hammer mounted on the chassis and configured to rotate in relation to the chassis between a first position and a second position; and a trigger slide mounted on the chassis and configured to move linearly in relation to the chassis between a first position and a second position; wherein the trigger slide includes a body, and a first rolling element mounted on the body; and the first rolling element is configured to engage and retain the hammer in the second position of the hammer when the trigger slide is in the first position of the trigger slide. In one embodiment, the first rolling element is configured to disengage from the hammer when the trigger slide is in the second position of the trigger slide. In another embodiment, the hammer has a substantially flat engagement surface and the first rolling element is configured to roll along the engagement surface when the trigger slide moves from the first to the second position of the trigger slide. In another embodiment, the first rolling element includes a pin, and a roller mounted on the pin and configured to rotate in relation to the pin and the body. In another embodiment, the first rolling element includes a pin roller configured to rotate in relation to the body. In another embodiment, the trigger mechanism further includes a second rolling element mounted on the chassis, wherein the trigger slide is coupled to the chassis by way of the second rolling element. In another embodiment, the second rolling element includes a pin; a first and a second roller mounted on the pin and configured to rotate in relation to the pin and the chassis; and a spacer mounted on the pin between the first and the second rollers. In another embodiment, the second rolling element includes a pin roller configured to rotate in relation to the chassis.

In another embodiment, the trigger mechanism further includes a first drop safety including an arm, wherein the first drop safety is mounted on the chassis and is configured to rotate in relation to the chassis between a first position at which the arm blocks movement of the trigger slide from the first to the second position of the trigger slide; and a second position. In another embodiment, the first drop safety further includes a body connected to the arm; and the body of the first drop safety is offset from an axis of rotation of the first drop safety so that the axis of rotation does not pass through the body of the first drop safety. In another embodiment, the first drop safety is biased toward the second position of the first drop safety; and the first drop safety is configured to rotate to the first position of the first drop safety when the firearm is dropped onto a contacting surface and strikes the contacting surface in a first predetermined orientation.

In another embodiment, the trigger mechanism further includes a second drop safety including an arm, and a body connected to the arm of the second drop safety, wherein: the second first drop safety is mounted on the chassis and is configured to rotate in relation to the chassis between a first position at which the arm of the second drop safety blocks movement of the trigger slide from the first to the second position of the trigger slide; and a second position; the body of the second drop safety is offset from an axis of rotation of the first drop safety so that the axis of rotation does not pass through the body of the second drop safety; the second drop safety is biased toward the second position of the second drop safety; and the second drop safety is configured to rotate to the first position of the second drop safety when the firearm is dropped onto a contacting surface and strikes the contacting surface in a second predetermined orientation. In another embodiment, the disclosed technology relates to a firearm that includes the trigger mechanism.

In another aspect, the disclosed technology relates to a trigger mechanism for a firearm, including: a chassis; a hammer mounted on the chassis and configured to rotate in relation to the chassis between a first position and a second position; a trigger slide mounted on the chassis and configured to move linearly in relation to the chassis between a first position and a second position, and to engage and retain the hammer in the second position of the hammer when the trigger slide is in the first position of the trigger slide; and a first drop safety including an arm, and a body connected to the arm; wherein the first drop safety is mounted on the chassis and is configured to rotate in relation to the chassis between a first position at which the arm is configured to block movement of the trigger slide from the first to the second position of the trigger slide, and a second position; and wherein the body is offset from an axis of rotation of the first drop safety so that the axis of rotation does not pass through the body. In one embodiment, the first drop safety is biased toward the second position of the first drop safety; and the first drop safety is configured to rotate to the first position of the first drop safety when the firearm is dropped onto a contacting surface and strikes the contacting surface in a first predetermined orientation. In another embodiment, the trigger slide includes a body having a notch formed therein; the notch is defined by at least one surface of the body of the trigger slide; and the body of the trigger slide is configured so that interfering contact between the arm and the surface when the arm is in the first position of the arm blocks movement of the trigger slide from the first to the second position of the trigger slide. In another embodiment, the notch incudes a slot configured to receive the arm of the first drop safety when the first drop safety is in the second position of the first drop safety and the trigger slide moves from the first to the second position of the trigger slide. In another embodiment, the arm of the first drop safety is located below the trigger slide when the first drop safety is in the second position of the first drop safety and the trigger slide moves from the first to the second position of the trigger slide.

In another embodiment, the trigger mechanism further includes a second drop safety including an arm, and a body connected to the arm of the second drop safety, wherein: the second first drop safety is mounted on the chassis and is configured to rotate in relation to the chassis between a first position at which the arm of the second drop safety blocks movement of the trigger slide from the first to the second position of the trigger slide; and a second position; the body of the second drop safety is offset from an axis of rotation of the second drop safety so that the axis of rotation does not pass through the body of the second drop safety; the second drop safety is biased toward the second position of the second drop safety; and the second drop safety is configured to rotate to the first position of the second drop safety when the firearm is dropped onto a contacting surface and strikes the contacting surface in a second predetermined orientation. In another embodiment, the disclosed technology relates to a firearm that includes the trigger mechanism.

BRIEF DESCRIPTION OF THE DRAWINGS

Embodiments will be described with reference to the following drawing figures, in which like reference numerals represent like parts and assemblies throughout the several views.

DETAILED DESCRIPTION

The inventive concepts are described with reference to the attached figures. The figures are not drawn to scale and are provided merely to illustrate some of the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

FIGS. 1-16 depict a trigger mechanism 10. Unless otherwise noted, directional references such as upper, lower, vertical, horizontal, etc., are made with reference to the orientation of the trigger mechanism as shown in FIGS. 3, 5, 8, and 10. The trigger mechanism 10 can be used in a firearm such as a rifle 100 shown in FIG. 1. The rifle 100 can be a Steyr AUG assault rifle. This particular application is disclosed for exemplary purposes only; the trigger 10 can be used in other types of firearms, such as but not limited to the FN P90 and IWI Tavor assault rifles.

Figure 1:
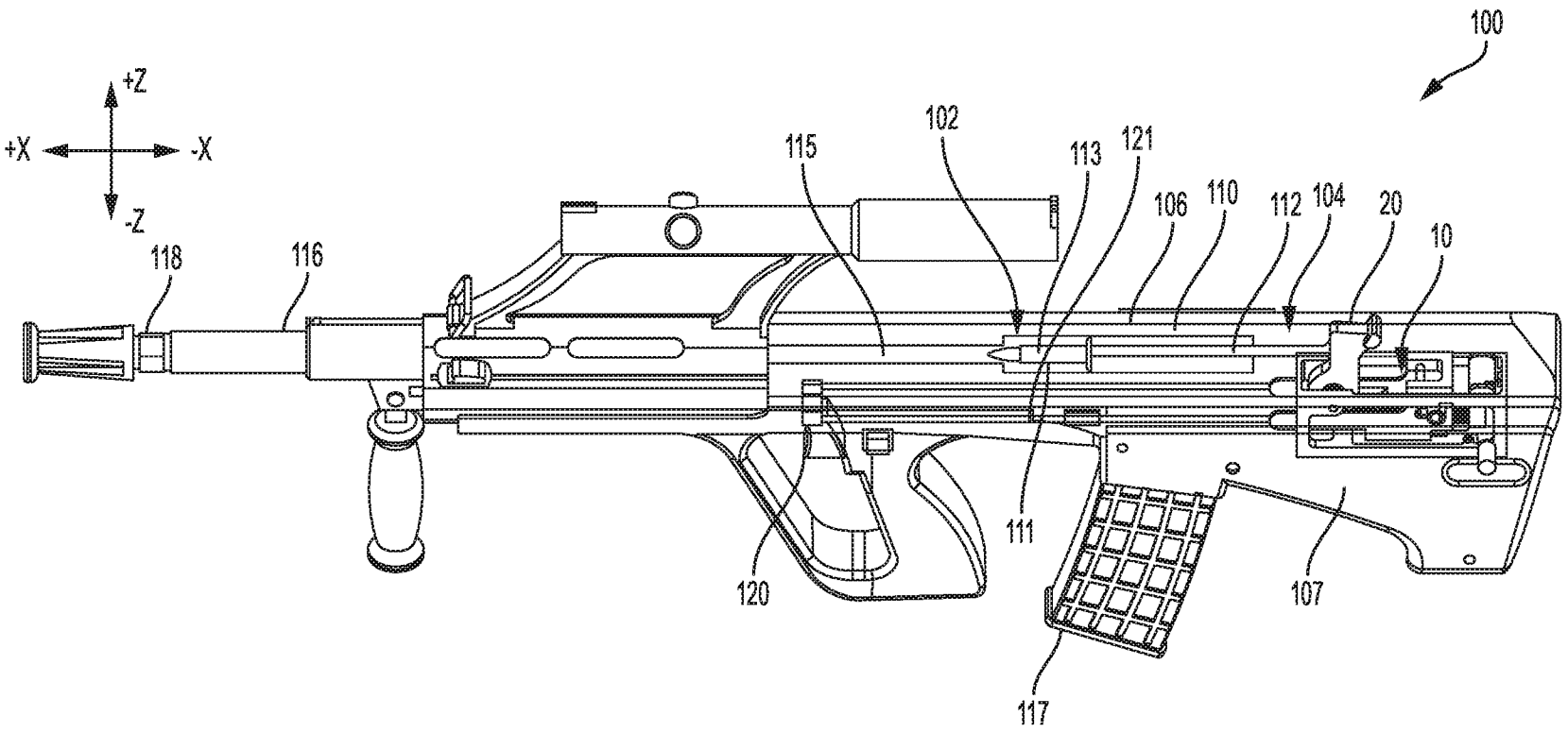
FIG. 1 is a side view of a rifle having a trigger mechanism as described below, and depicting various internal components of the rifle.

Referring to FIG. 1, the rifle 100 comprises a receiver 102 and a bolt carrier assembly 104. The receiver 102 is mounted on a buttstock 107 of the rifle 100. The bolt carrier assembly 104 includes a bolt carrier 106, a bolt 110, and a firing pin 112. The bolt 110 is positioned within a bore formed in the bolt carrier 106, and is configured to translate linearly, in the "x" direction, in relation to the bolt carrier 106. The firing pin 112 extends through a bore formed in the bolt 110, and is configured to translate linearly in relation to the bolt 110. The bolt carrier 106 is positioned on two guide rails that permit the bolt carrier assembly 104 to translate linearly in relation to the receiver 102 and the buttstock 107. The bolt carrier assembly 104 is biased in the forward, or "+x" direction, by a recoil spring (not shown).

The receiver 102 has a chamber 111 that receives an unfired cartridge 113. The firing sequence for the rifle 100 is initiated when the user pulls a trigger 120 of the rifle 100. As explained in detail below, pulling the trigger 120 results in the release of a spring-loaded hammer 20 of the trigger mechanism 10. The hammer 20 strikes a rearward end of the firing pin 112, which causes a forward end of the firing pin 112 to strike the rearward end of the cartridge 113, igniting an impact-sensitive primer in the cartridge 113. The primer ignites a propellant within the cartridge. The expanding propellant gas propels a projectile of the cartridge 113 out of the chamber 111, and into and through a bore 115 formed in a barrel 116 of the rifle 100. The projectile subsequently exits the open end, or muzzle 118 of the barrel 116.

Structure and Operation of the Trigger Mechanism 10

The trigger mechanism 10 comprises the above-noted hammer 20, a trigger slide 22, and a frame or chassis 26. The hammer 20 is mounted on the chassis 26 by way of a pin 28. Ends of the pin 28 are disposed in apertures formed in opposite sides of the chassis 26, and are secured within the apertures by an interference fit or other suitable means. The pin 28 permits the hammer 20 to rotate in relation to the chassis 26 between a first position (e.g., shown as a released position in FIGS. 2, 5, 6, 9, and 10) and a second position (shown as a cocked position in FIGS. 3, 4, 7, 9, and 11-14). The trigger mechanism 10 further includes two springs 30 positioned around the pin 28; a single spring can be used in lieu of the two springs 30 in alternative embodiments. The spring(s) 30 bias the hammer 20 in a counter-clockwise direction from the perspective of FIGS. 3, 5, 8, and 10, toward the released position.

Figure 5:
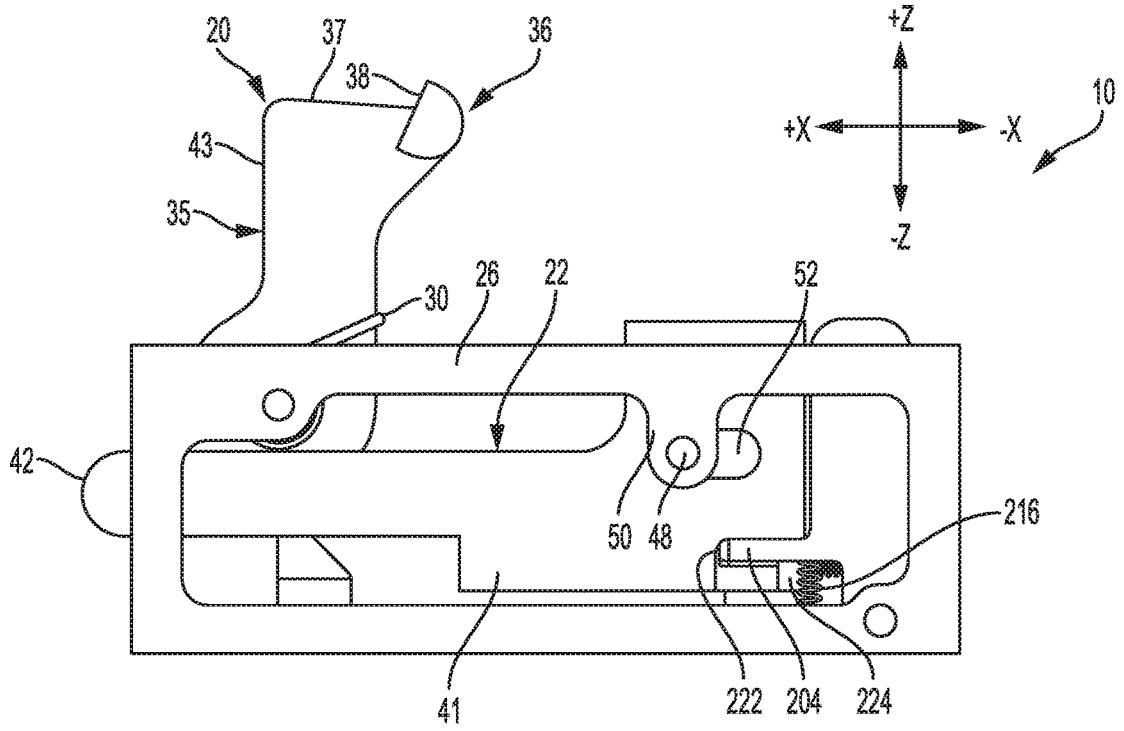
FIG. 5 is a left side view of the trigger mechanism shown in FIGS. 3-4, with the hammer in the released position, the trigger slide in a pulled back position immediately after release of the hammer, and the first and second drop safeties the un-deflected positions.
Figure 8:
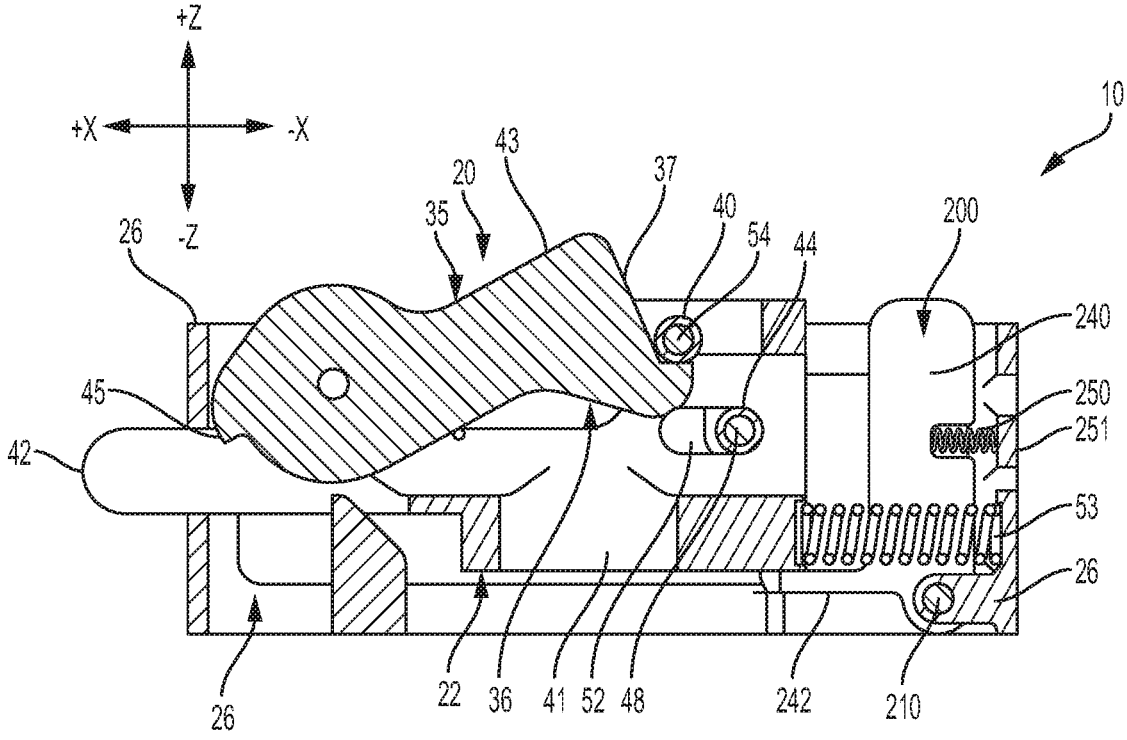
FIG. 8 is a cross-sectional view of the trigger mechanism shown in FIGS. 3-7, taken through the line "A-A" of FIG. 7.
Figure 9:
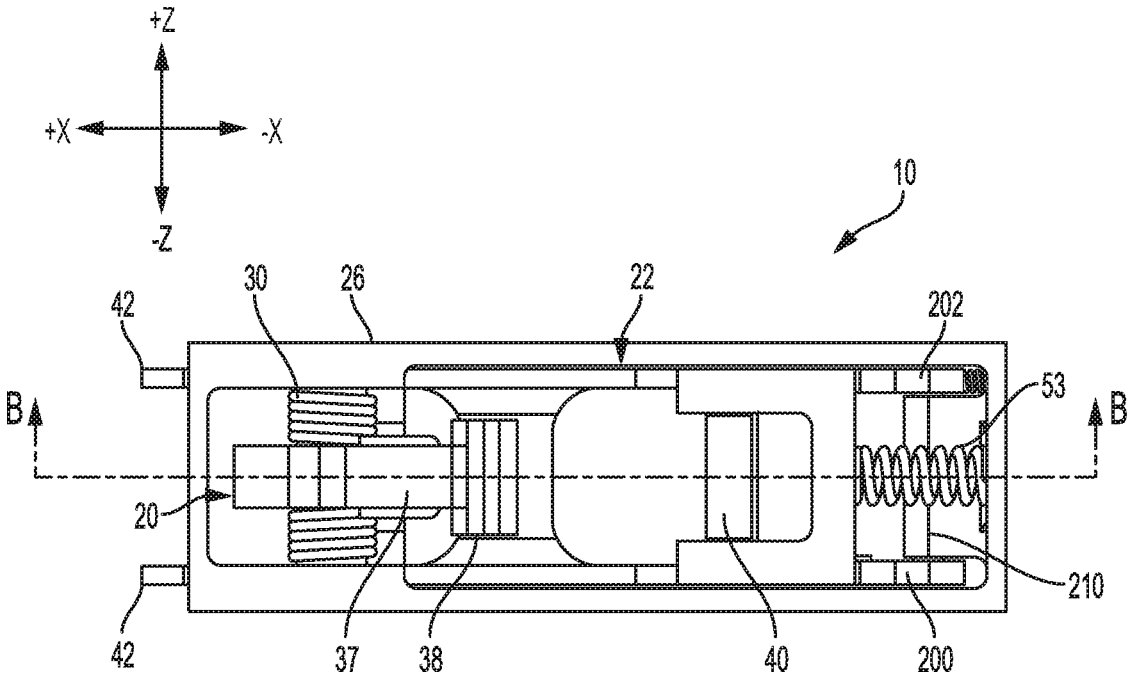
FIG. 9 is a top view of the trigger mechanism shown in FIGS. 3-8, with the hammer in the released position, the trigger slide in the pulled back position immediately after release of the hammer, and the first and second drop safeties in the un-deflected positions.
Figure 10:
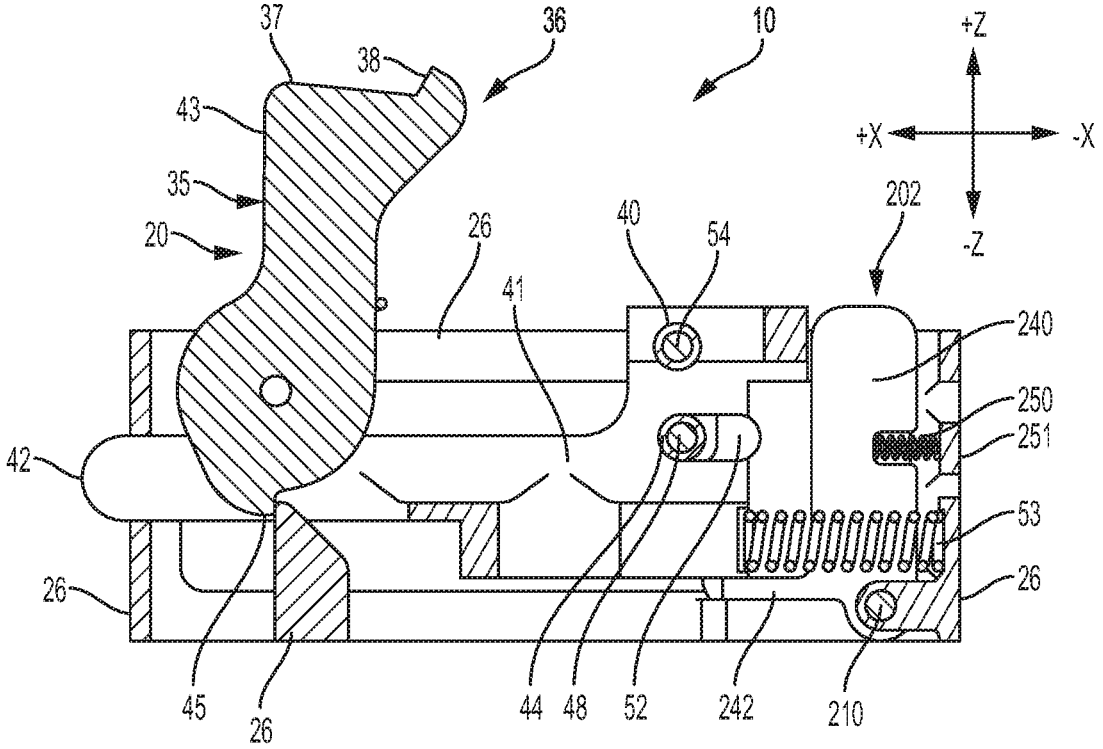
FIG. 10 is a cross-sectional view of the trigger mechanism shown in FIGS. 3-9, taken through the line "B-B" of FIG. 9.

The hammer 20 includes a body 35, and an engagement portion 36 that adjoins the body 35 as shown, for example, in FIGS. 5, 8, and 10. The body 35 has a substantially flat surface portion 37. The engagement portion 36 has an elongated, substantially flat roller engagement surface 38 that adjoins the surface portion 37. As discussed below, the roller engagement surface 38 contacts a sear roller 40 mounted on the trigger slide 22 when the hammer 20 is in the cocked position. Contact between the sear roller 40 and the roller engagement surface 38 retains the hammer 20 in the cocked position until the hammer 20 is released as described below.

The body 35 also has a substantially flat striking surface 43. The striking surface 43 impacts the firing pin 112 of the rifle 100 when the hammer 20 rotates to its released position under the bias of the springs 30. The contact between the striking surface 43 and the firing pin 112 drives the firing pin 112 into the unfired cartridge 113 positioned in the chamber 111 of the rifle 100, initiating the discharge of the cartridge 113 as discussed above.

The body 35 also includes a lip 45. The lip 45 is configured to engage the chassis 26 when the hammer 20 reaches its released position as shown in FIG. 10, thereby preventing further rotation of the hammer 20. The lip 45 thus acts as a stop for the hammer 20.

Figure 2:
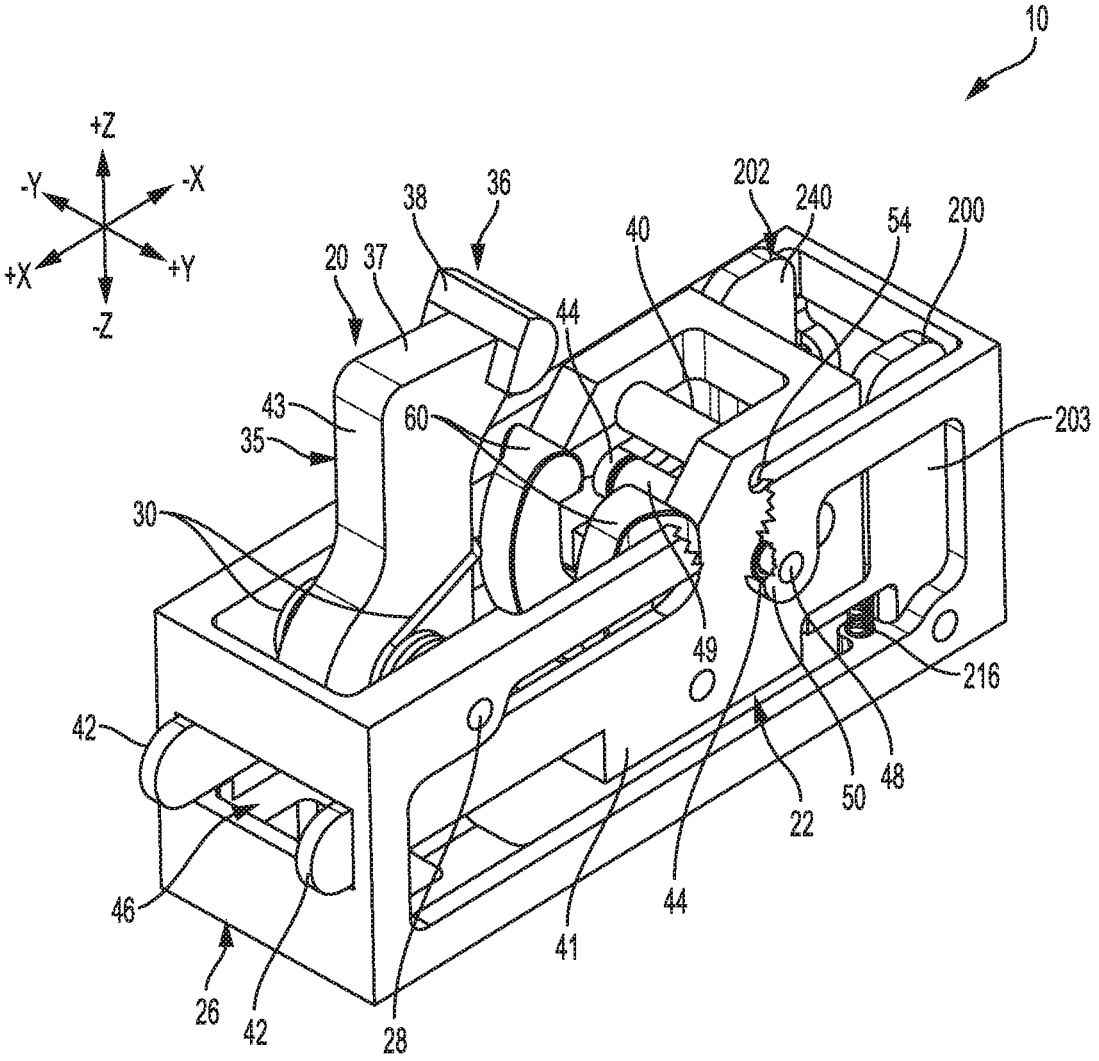
FIG. 2 is a left-front perspective view of the trigger mechanism of the rifle shown in FIG. 1, with a hammer of the mechanism in a released position, a trigger slide of the mechanism in a not pulled position, and first and second drop safeties of the mechanism in un-deflected positions.
Figure 2A:
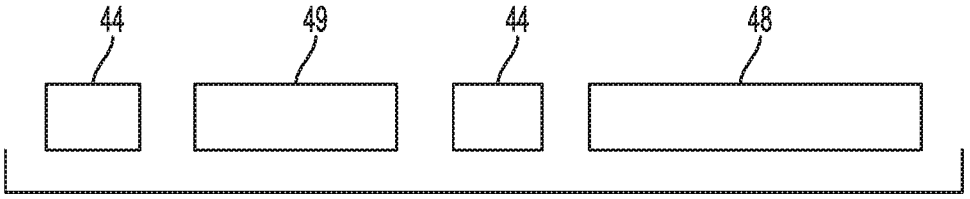
FIG. 2A is an exploded view of a rolling element of the trigger mechanism of FIG. 2.

The trigger slide 22 is positioned within and suspended from the chassis 26. The trigger slide 22 is configured to move linearly, in its lengthwise or "x" direction, between a first position (e.g., shown as a not pulled positon in FIGS. 2, 3, 4, 7, 8, and 11-14); and a second position (e.g., shown as a pulled back position in FIGS. 5, 6, 9 and 10). The trigger slide 22 comprises a body 41, and two arms 42 that adjoin a forward end of the body 41. The arms 42 extend in the lengthwise or "x" direction of the trigger mechanism 10, and pass through an opening 46 in the forward end of the chassis 26, as shown in FIG. 2; alternative embodiments can include more than one opening 46 in the forward end of the chassis 26. The trigger slide 22 is suspended from the chassis 26 by way of the arms 42, and a rolling element in the form of two slide rollers 44 and a pin 48. Each slide roller 44 has a cylindrical configuration, and is mounted for rotation on the pin 48 as shown in FIGS. 2, 2A, 8, and 10. A cylindrical spacer 49 is also positioned on the pin 48, between the slide rollers 44. The ends of the pin 48 are disposed in respective apertures formed in flanges 50 located on opposite sides of the chassis 26. The ends of the pin 48 can be retained within the apertures by an interference fit or other suitable means. A single roller disposed for rotation on the pin 48 can be used in lieu of the slide rollers 44 and spacer 49 in alternative embodiments.

The pin 48 and the slide rollers 44 extend through slots 52 formed in opposite sides of the trigger slide 22. The slots 52 extend in the lengthwise or "x" direction of the trigger slide 22, as shown in FIGS. 3, 5, 8, and 10. The slots 52, in conjunction with the opening 46 in the chassis 26, permit the trigger slide 22 to move between its not pulled and pulled back positions. The trigger slide 22 is biased toward its not pulled positon by a spring 53 positioned between the rearward end of the trigger slide 22 and a tab 56 that forms part of the rearward end of the chassis 26. The tab 56 is shown, for example, in FIGS. 4 and 6.

The respective diameters of the pin 48 and the slide rollers 44 are chosen so that the slide rollers 44 can rotate freely on the pin 48. The ability of the slide rollers 44 to rotate helps to minimize friction between the slide rollers 44 and the chassis 26 as the trigger slide 22 moves between its not pulled and pulled back positions. The pin 48 can have a diameter, for example, of about 0.1 inch to about 0.2 inch, such as about 0.13 inch to about 0.18 inch; and a length, for example, of about 1.1 inch to about 1.7 inch, such as about 1.17 inch to about 1.58 inch. The slide rollers 44 can have an inside diameter, for example, of about 0.1 inch to about 0.19 inch, such as about 0.13 inch to about 0.18 inch; an outside diameter, for example, of about 0.18 inch to about 0.30 inch, such as about 0.24 inch; and a length, for example, of about 0.15 inch to about 0.3 inch, such as about 0.2 inch to about 0.27 inch.

The sear roller 40 has a tubular configuration, and is mounted for rotation on a pin 54 as shown in FIGS. 2, 8, and 10. The sear roller 40 and the pin 54 together form a rolling element. The ends of the pin 54 are disposed in respective apertures formed in opposite sides of the body 41 of the trigger slide 22. The ends can be retained in the apertures by an interference fit or other suitable means. The respective diameters of the pin 54 and the sear roller 40 are chosen so that the sear roller 40 can rotate freely on the pin 54. The ability of the sear roller 40 to rotate helps to minimize friction between the sear roller 40 and the roller engagement surface 38 of the hammer 20 as the hammer 20 is released in the manner described below. The pin 54 can have a diameter, for example, of about 0.12 inch to about 0.2 inch, such as about 0.13 inch to about 0.18 inch; and a length, for example, of about 0.8 inch to about 1.4 inch, such as about 0.94 inch to about 1.27 inch. The sear roller 40 can have a length, for example, of about 0.48 inch to about 0.8 inch, such as about 0.54 inch to about 0.73 inch. The roller engagement surface 38 can have a length or "y" dimension, for example, of about 0.2 inch to about 0.7 inch, such as about 0.30 inch to about 0.67 inch; and a width or "x" dimension, for example, of about 0.12 inch to about 0.2 inch, such as about 0.14 inch to about 0.19 inch.

Figure 7:
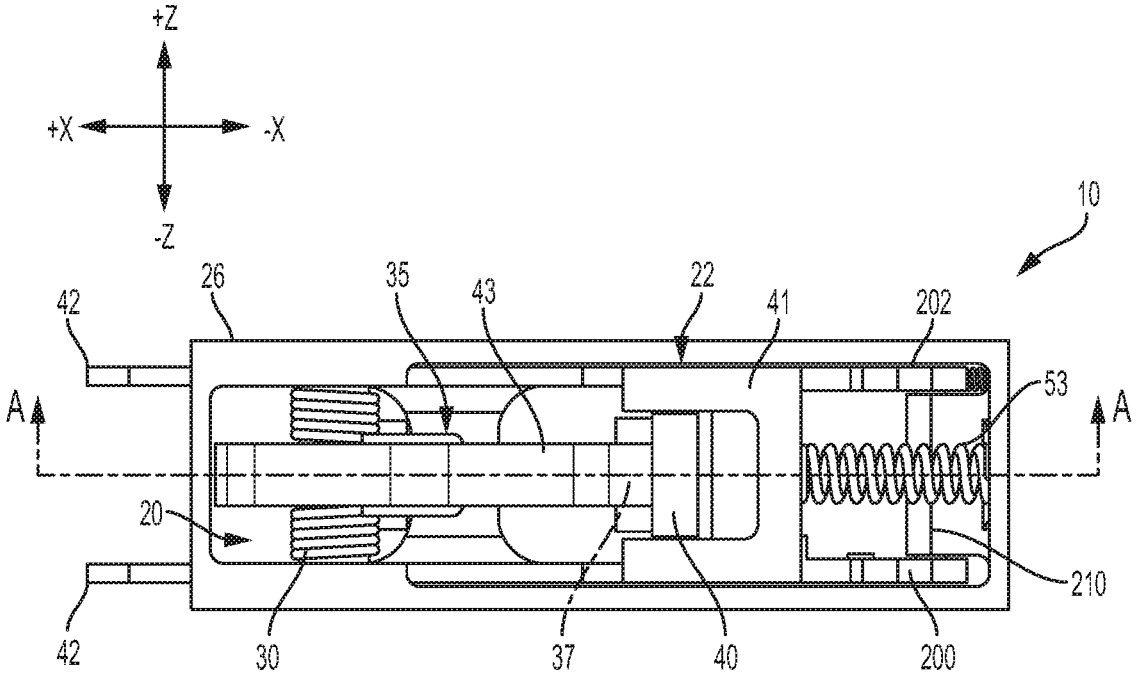
FIG. 7 is a top view of the trigger mechanism shown in FIGS. 3-6, with the hammer in the cocked position, the trigger slide in the not pulled position, the first and second drop safeties in the un-deflected positions.

FIGS. 7 and 8 depict the trigger mechanism 10 in a condition ready to initiate the firing sequence for the firearm 10. The hammer 20 is in its cocked position; the trigger slide 22 is in its not pulled position; and the sear roller 40 is in contact with the roller engagement surface 38 of the hammer 20. As can be seen in FIG. 8, the hammer 20 is restrained from rotating counter-clockwise under the bias of the springs 30 by interfering contact between the sear roller 40 and the roller engagement surface 38. The sear roller 40 is urged forwardly, in the "+x" direction, by the bias of the spring 53 acting on the trigger slide 22, with contact between the slide rollers 44 and the forward edges of their associated slots 52 limiting the forward movement of the sear roller 40 and the trigger slide 22, as can be seen in FIG. 10. The forward bias of the spring 53 causes the sear roller 40 to remain in position over the roller engagement surface 38 as depicted in FIG. 10, thereby inhibiting disengagement of the sear roller 40 from the roller engagement surface 38 before the firing sequence is initiated.

The firing sequence for the rifle 100 occurs as follows. The firing sequence is initiated when the user pulls the trigger 120. The trigger 120 is connected to the forward end a rigid trigger transfer linkage 121. A rearward end of the trigger transfer linkage 121 abuts the arms 42 of the trigger slide 22. Pulling the trigger 120 causes the trigger 120 to move rearward, in the "−x" direction. The rearward movement of the trigger 120 imparts a corresponding rearward movement to the trigger transfer linkage 121, which in turn urges the trigger slide 22 rearward, from its not pulled position and toward its pulled back position. The rearward movement of the trigger slide 22 causes the pin 54 to move rearward in a corresponding manner as can be seen, for example, in FIG. 11. The rearward movement of the pin 54 causes the sear roller 40 to rotate on the pin 54 and to roll along the roller engagement surface 38 of the hammer 20 as the sear roller 40 moves rearward with the pin 54.

As discussed above, the hammer 20 is restrained in its cocked position, against the bias of the springs 30, by contact between the sear roller 40 and the roller engagement surface 38. The hammer 20 is released when the line of contact between the sear roller 40 and the roller engagement surface 38 reaches the rearward edge of the roller engagement surface 38, which coincides approximately with the point at which the trigger slide 22 reaches its pulled back position. At this point, the sear roller 40 can roll over the rearward edge of the roller engagement surface 38, allowing the hammer 20, which is no longer restrained by the sear roller 40, to rotate toward its released position under the bias of the springs 30.

When the hammer 20 reaches its released positon, shown in FIGS. 2, 5, 6, 9, and 10, the striking surface 43 of the hammer 20 strikes the firing pin 112, resulting in the discharge of a projectile from the rifle 100 in the manner described above.

The trigger mechanism 10 is reset as follows. Rearward movement of the bolt carrier 106 immediately after discharge of the cartridge 113 drives a cocking piece of the bolt carrier assembly 104 into contact with the hammer 20. Continued rearward movement of the bolt carrier 106 causes the hammer 20 to rotate in a clockwise direction, from the perspective of FIG. 3. As the hammer 20 approaches its cocked position, a disconnector 60 of the trigger assembly 10 contacts the engagement portion 36 of the hammer 20. The disconnector 60 restrains the hammer 20 from rotating counter-clockwise under the bias of the spring(s) 30 after the cocking piece has disengaged from the hammer 20 as the bolt carrier 106 moves forward under the bias of the recoil spring. The disconnector 60 is depicted in FIG. 2; the disconnector 60 is not depicted in the remaining figures, for clarity of illustration.

When the user releases the trigger 120, the trigger slide 22 moves forward under the bias of the spring 53. The sear roller 40, which is aligned with the roller engagement surface 38 of the hammer 20 when the hammer 20 is in its cocked position, rolls onto the roller engagement surface 38 as the trigger slide 22 moves forward, toward its not pulled position. Also, the forward movement of the trigger slide 22 causes the disconnector 60 to rotate out of contact with the hammer 20. Thus, when the trigger slide 22 reaches a not pulled position, the disconnector 60 no longer restrains the hammer 20. Rather, hammer 20 is restrained from counter-clockwise movement solely by engagement of sear roller 40 and roller engagement surface 38. The trigger mechanism 10 at this point has been reset, and is ready to initiate the discharge of another cartridge 113.

The sear roller 40 helps to reduce the amount of friction acting on the trigger slide 22 as the trigger slide 22 disengages from the hammer 20 to initiate the firing sequence. The slide rollers 44 likewise help to reduce the amount of friction acting on the trigger slide 22 as the trigger slide 22 moves in relation to the chassis 26. This can result in a low trigger pull weight, a smooth trigger pull, and low wear of the interface between the hammer 20 and the trigger slide 22 in comparison to a comparable trigger mechanism in which the hammer slides along its interface with the trigger slide, and the trigger slide slides along its interface with the carriage. Also, the reduction in friction is achieved without limiting the size of the roller engagement surface 38; such a limitation in size could increase the potential for inadvertent disengagement of the hammer 20 and the trigger sear 22. Instead, the roller engagement surface 38 can be sized to provide a platform for the sear roller 40 that is large and stable enough to minimize the potential for inadvertent disengagement of the hammer 20 and the trigger sear 22, and accidental discharge of the rifle 100.

Alternative Embodiments With Rolling Pins

Figure 17:
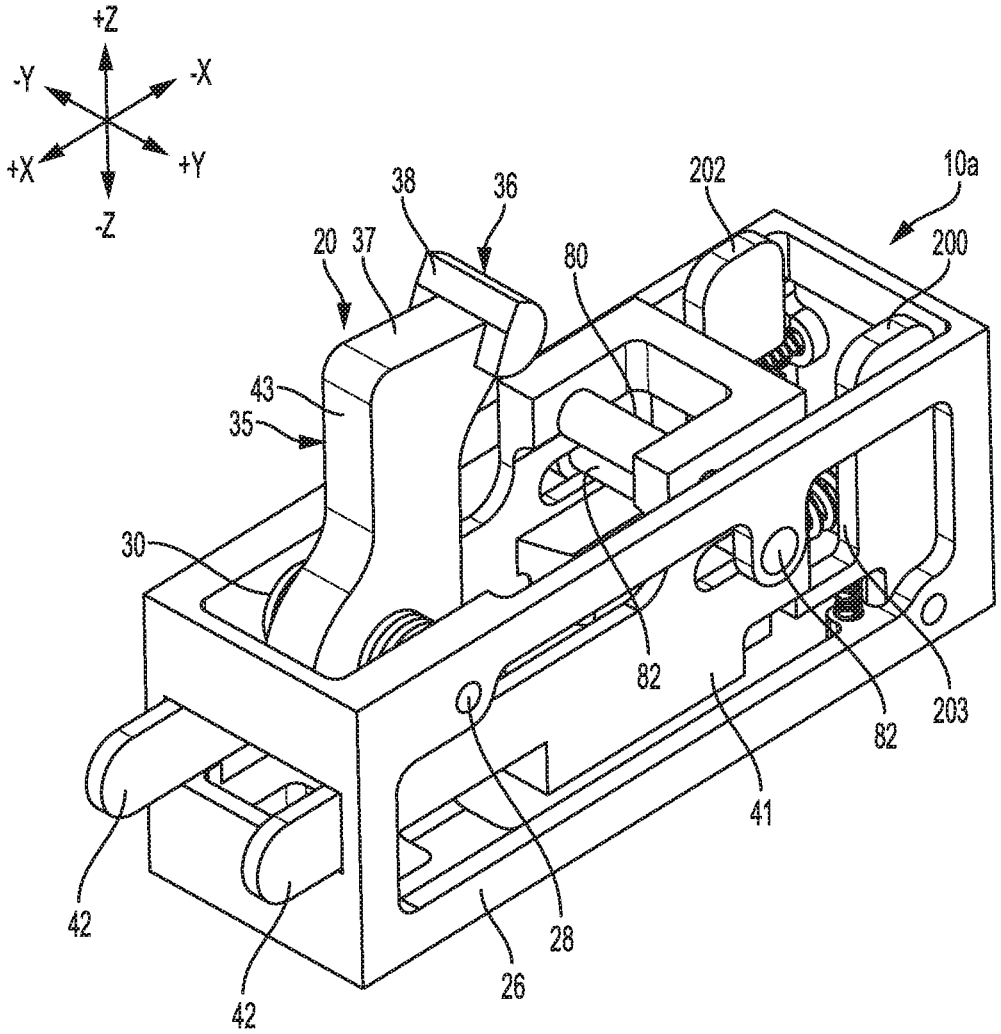
FIG. 17 is a left-front perspective view of an alternative embodiment of the trigger mechanism shown in FIGS. 1-16, with the hammer in the released position, the trigger slide in the not pulled position, and the first and second drop safeties in the un-deflected positions.

FIG. 17 depicts an alternative embodiment of the trigger mechanism 10 in the form of a trigger mechanism 10*a*. The structure and operation of the trigger mechanism 10*a* are substantially identical to those of the trigger mechanism 10, with the below exceptions. Identical reference characters are used in the figures to refer to identical parts of the trigger mechanism 10*a* and the trigger mechanism 10.

The trigger mechanism 10*a* includes a rolling element in the form of a sear roller pin 80, in lieu of the sear roller 40 and pin 54 of the trigger mechanism 10. The trigger mechanism 10*a* also includes a rolling element in the form of a slide roller pin 82, in lieu of the slide rollers 44, spacer 49, and pin 48 of the trigger mechanism 10.

The sear roller pin 80 is configured to fit within apertures in the body 41 of the trigger slide 22 with sufficient clearance to permit the sear roller pin 80 to rotate in relation to the body 41. The ends of the sear roller pin 80 can be retained in the apertures by the chassis 26; clips or other suitable means can be used to retain the sear roller pin 80 in alternative embodiments. The sear roller pin 80 interfaces with the hammer 20 in a manner substantially identical to the sear roller 40 of the trigger mechanism 10. Rolling elements other than sear roller pins and sear rollers can be used as the interface between the trigger slide 22 and the hammer 20 in other alternative embodiments.

The slide roller pin 82 is configured to fit within apertures in the chassis 26 with sufficient clearance to permit the slide roller pin 82 to rotate in relation to the chassis 26. The ends of the slide roller pin 82 can be retained in the apertures by clips or other suitable means. The slide roller pin 82 interfaces with the body 41 of the trigger slide 22 in a manner substantially identical to the slide rollers 44 of the trigger mechanism 10. Rolling elements other than sear roller pins and sear rollers can be used couple the trigger sear 22 and the chassis 26 in other alternative embodiments.

Other alternative embodiments can be equipped with the sear roller pin 80 of the trigger mechanism 10*a*, and the slide rollers 44, spacer 49, and pin 48 of the trigger mechanism 10. Still other alternative embodiments can be equipped with the slide roller pin 82 of the trigger mechanism 10*a*, and the sear roller 20 and pin 54 of the trigger mechanism 10.

Alternative Embodiments with Alternate Trigger Location

Figure 18:
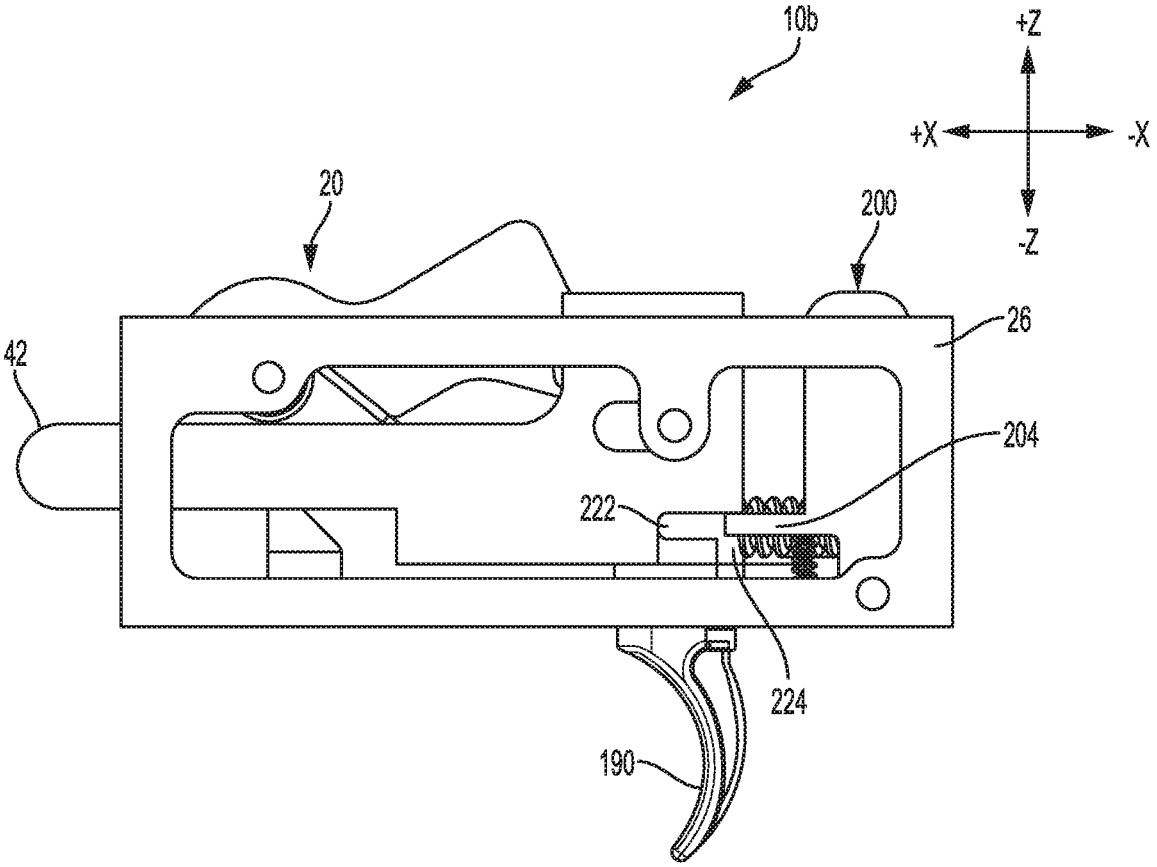
FIG. 18 is a left side view of another alternative embodiment of the trigger mechanism shown in FIGS. 3-16, with the hammer in a cocked position, the trigger slide in a not pulled position, and the first and second drop safeties in the un-deflected positions.
Figure 19:
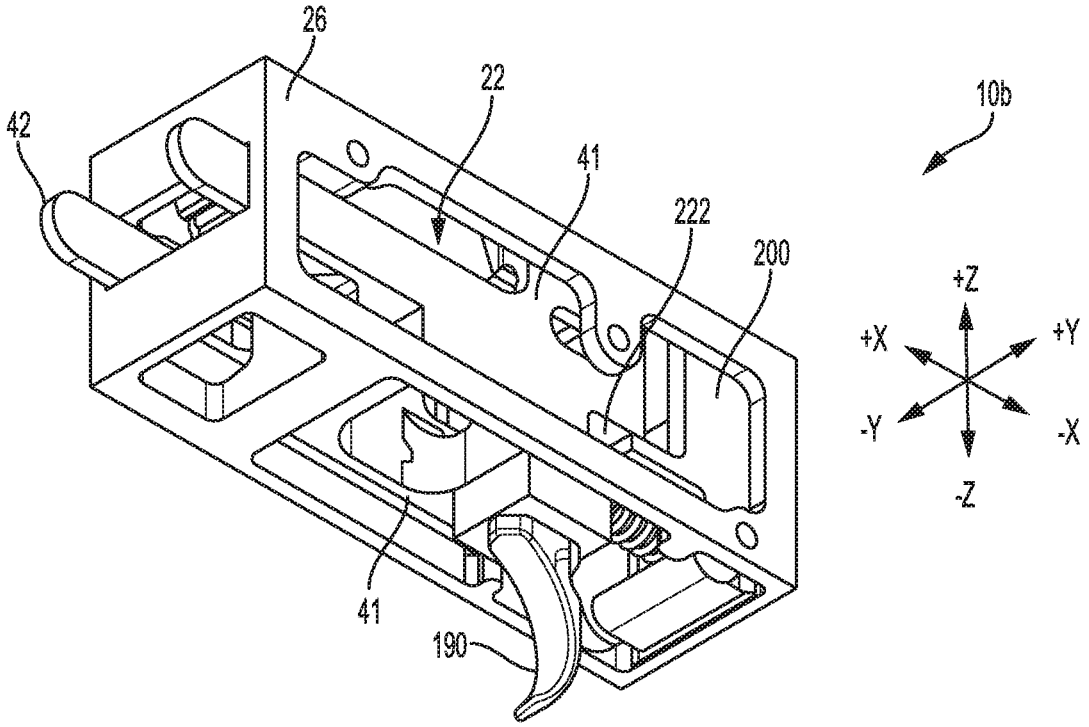
FIG. 19 is a left-front perspective view of the trigger mechanism shown in FIG. 18, with the hammer in the cocked position, the trigger slide in the not pulled position, and the first and second drop safeties in the un-deflected positions.

FIGS. 18 and 19 depict an alternative embodiment in the form of a trigger mechanism 10*b*, in which a trigger 190 is connected directly to the body 41 of the trigger slide 22. In this embodiment, the trigger force acts directly on the trigger mechanism 10, instead of being transmitted through the trigger transfer linkage 121 of the rifle 100. This alternative trigger positioning also can be applied to the trigger mechanism 10*b*.

Drop Safeties

The trigger mechanism 10, and its above-described alternative embodiments, also include a muzzle drop safety 200, and a buttstock drop safety 202. The muzzle drop safety 200 can inhibit inadvertent discharge of the rifle 100 when the rifle 100 is dropped in an orientation such that its muzzle 118 strikes the ground before the remainder of the rifle 100. This situation is depicted in FIGS. 11 and 12, with the arrow 270 indicating the direction in which the rifle 100 is traveling as it strikes the ground 272 or other contacting surface.

Figure 13:
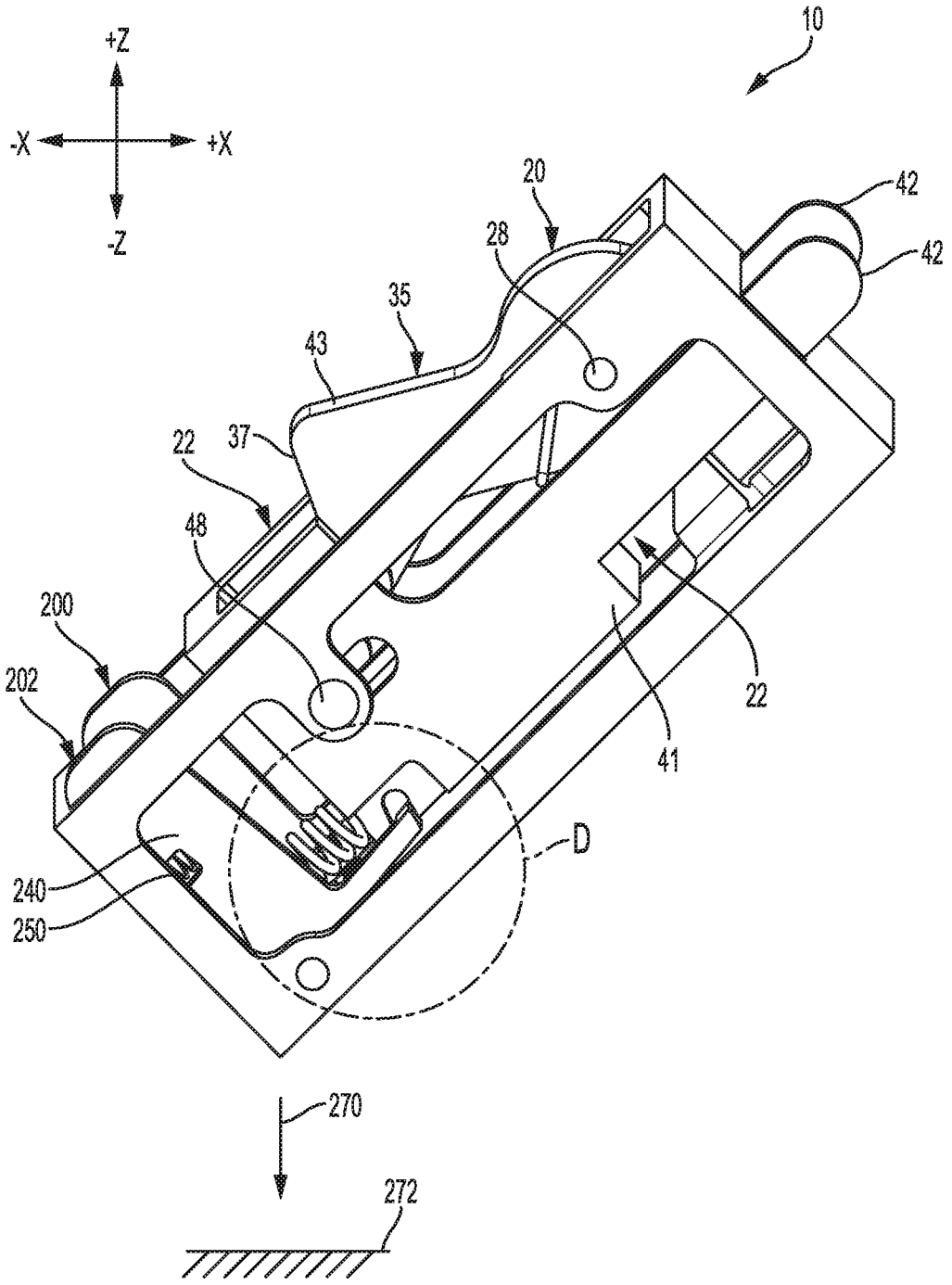
FIG. 13 is a side view of the trigger mechanism shown in FIGS. 3-12, immediately after the firearm contacts the ground in a buttstock-down attitude after being dropped; with the hammer in the cocked position, the trigger slide in the not pulled position, the first drop safety in the un-deflected position, and the second drop safety in the deflected position.
Figure 14:
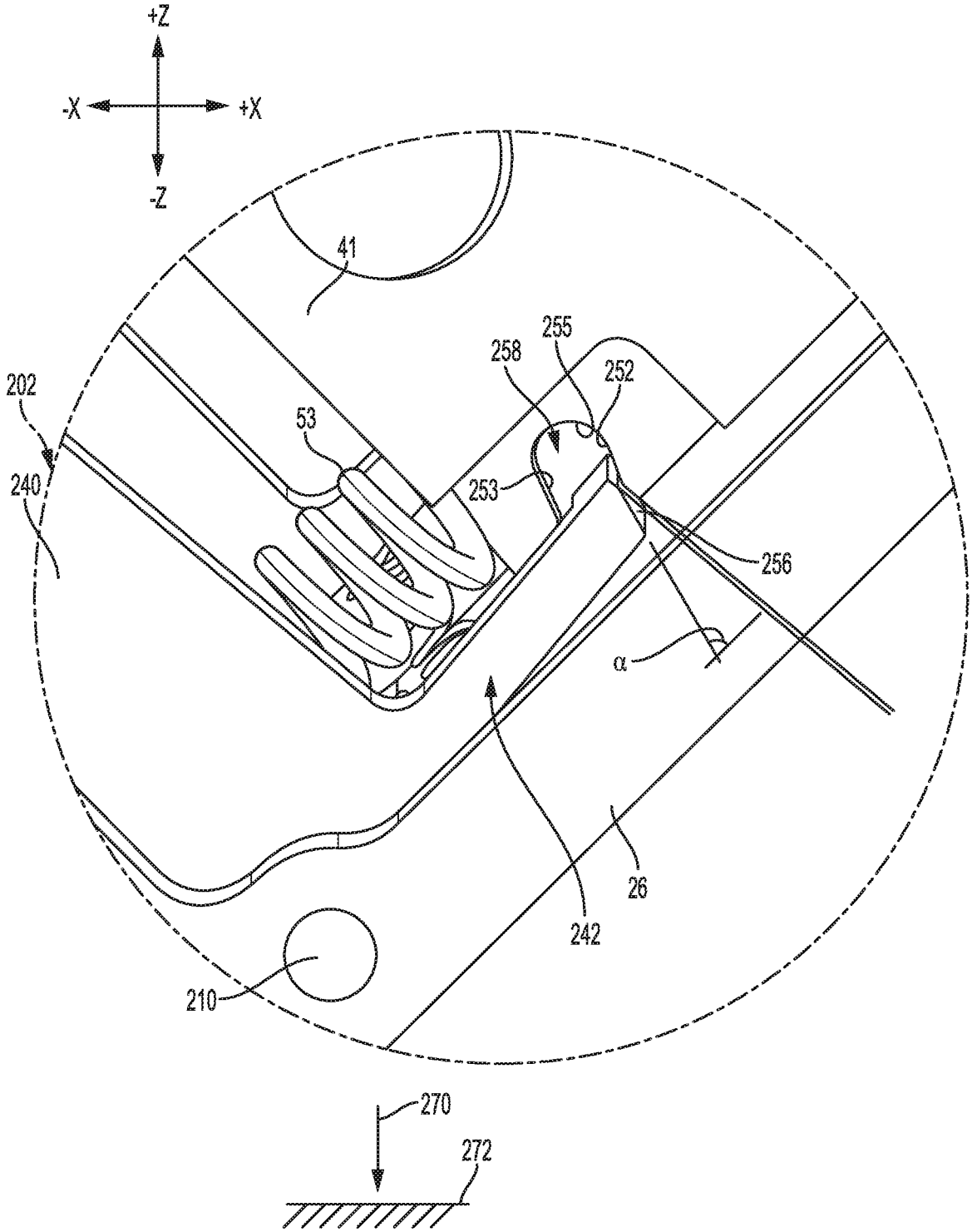
FIG. 14 is a magnified view of the area designated "D" in FIG. 13.

The buttstock drop safety 202 can inhibit inadvertent discharge of the firearm 10 when the rifle 100 is dropped in an orientation such that its buttstock 107 strikes the ground before the remainder of the rifle 100. This situation is depicted in FIGS. 13 and 14, with the arrow 270 again indicating the direction in which the rifle 100 is traveling as it contacts the ground 272 or other contacting surface.

Figure 15:
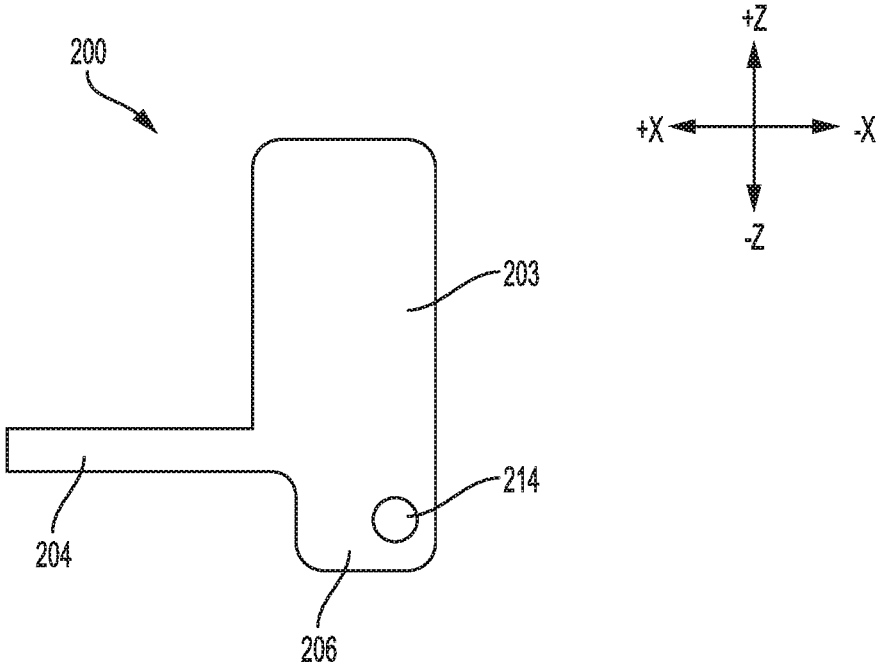
FIG. 15 is a side view of the first drop safety of the trigger mechanism of FIGS. 3-14.

The muzzle drop safety 200 comprises a body 203, an arm 204, and a mounting portion 206, as depicted in FIG. 15. The arm 204 adjoins the body 203 and extends forwardly, in the "+x" direction, from the body 203. The mounting portion 206 adjoins the body 203 and extends downwardly, in the "−z" direction, from the body 203. The body 203 can have a height or "z" dimension, for example, of about 0.6 inch to about 1 inch, such as about 0.68 inch to about 0.92 inch; a length, or "x" dimension, for example, of about 0.4 inch to about 0.8 inch, such as about 0.53 inch to about 0.72 inch; and a width or "y" dimension, for example, of about 0.08 inch to about 0.4 inch, such as about 0.1 inch to about 0.33 inch. The mounting portion 206 can have a maximum height, for example, of about 0.2 inch to about 0.33 inch, such as about 0.22 inch to about 0.3 inch; and a width, for example, of about 0.08 inch to about 0.4 inch, such as about 0.1 inch to about 0.33 inch.

Figure 11:
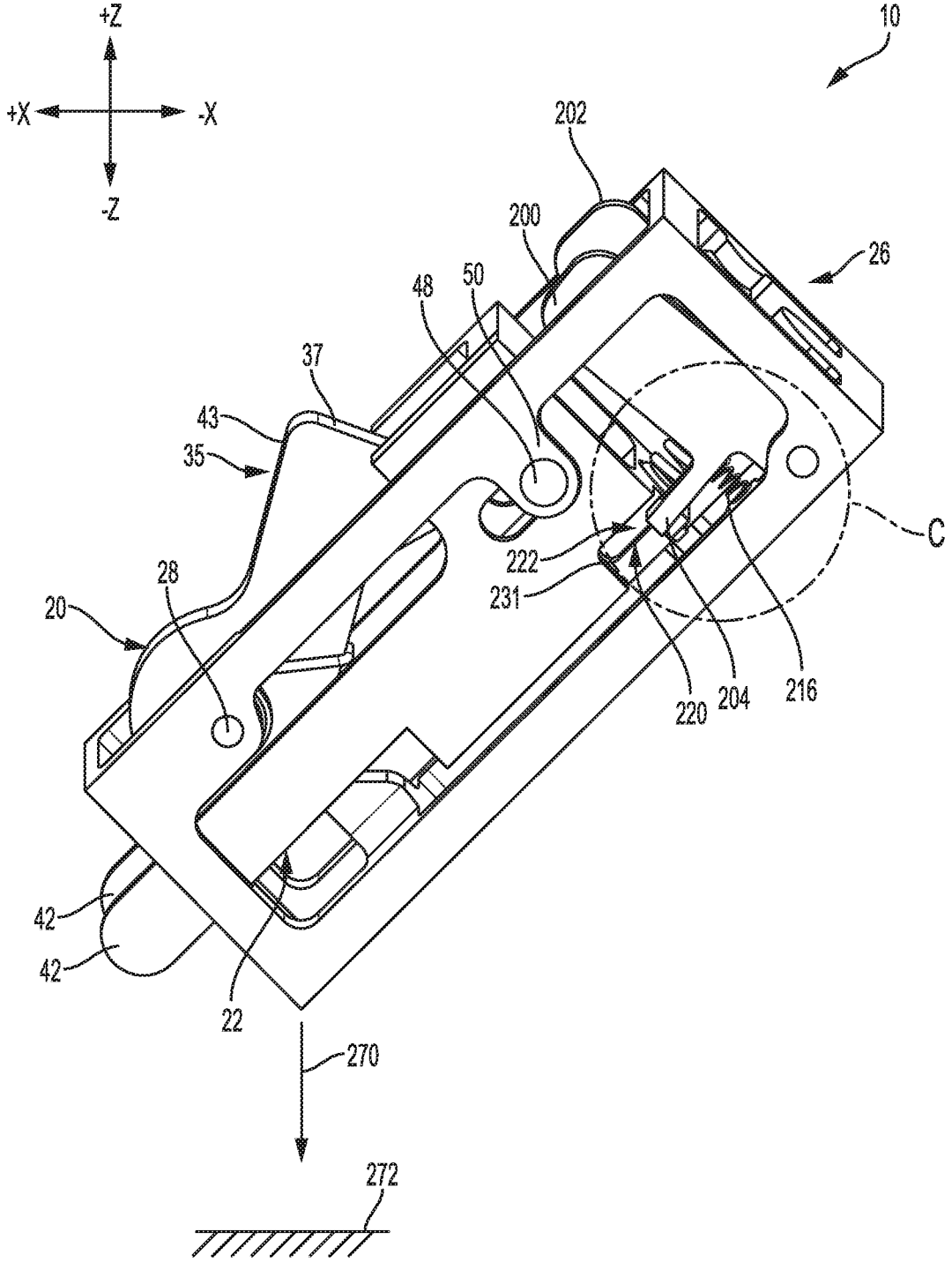
FIG. 11 is a side view of the trigger mechanism shown in FIGS. 3-10, immediately after the firearm contacts the ground in a muzzle-down attitude after being dropped; with the hammer in the cocked position, the trigger slide in the not pulled position, the first drop safety in the deflected position, and the second drop safety in the un-deflected position.
Figure 12:
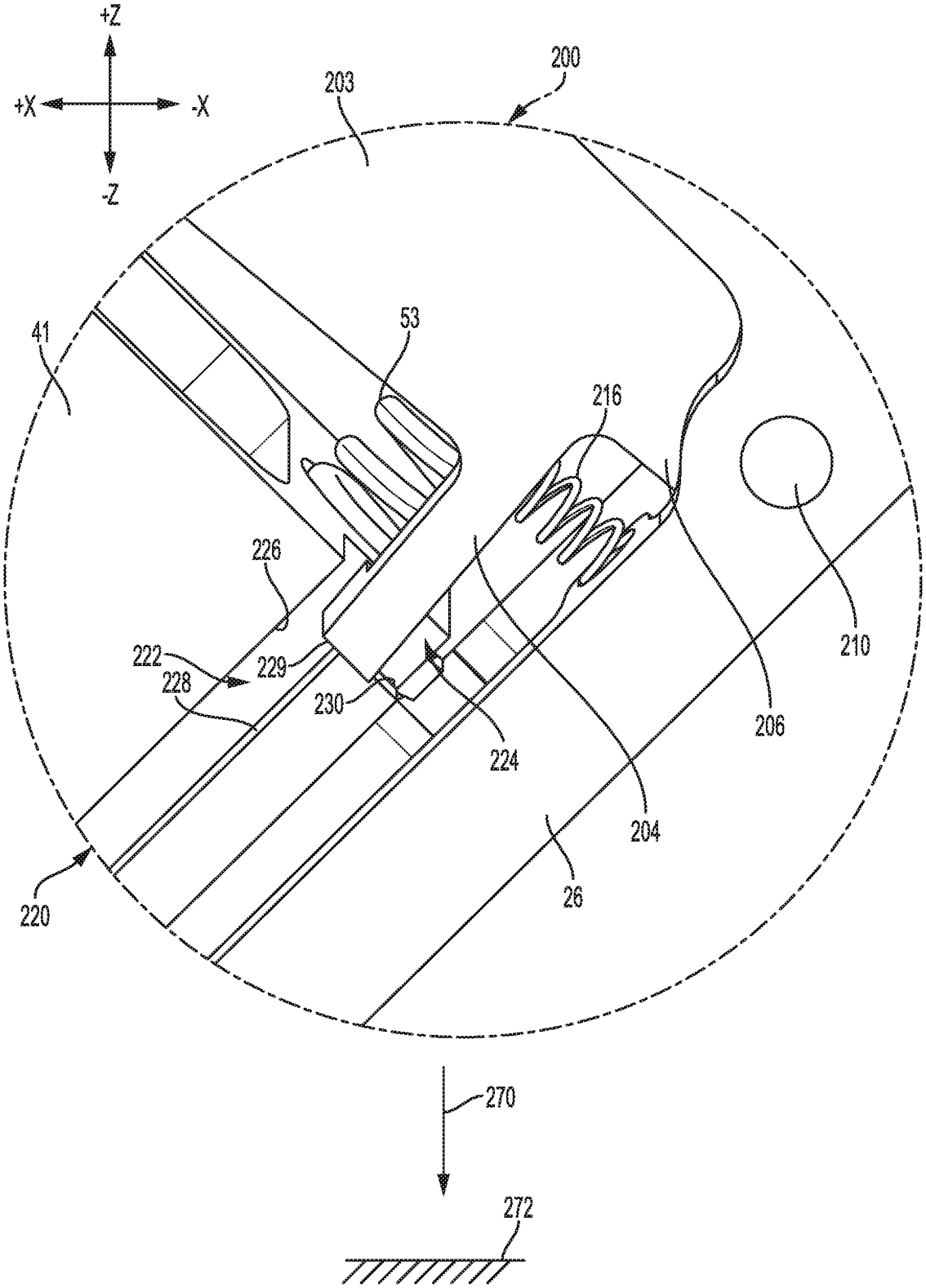
FIG. 12 is a magnified view of the area designated "C" in FIG. 11.

The muzzle drop safety 200 is mounted proximate a lower rearward corner of the chassis 26, as shown in FIG. 11. The muzzle drop safety 200 is coupled to the chassis 26 by way of a pin 210 that spans the width of the chassis 26. The ends of the pin 210 are positioned in apertures formed in opposite sides of the chassis, and are secured in their respective apertures by an interference fit or other suitable means.

The pin 210 extends through an aperture 214 formed in the mounting portion 206 of the muzzle drop safety 200. The diameter of aperture 214 is selected to permit the muzzle drop safety 200 to rotate freely in relation to the pin 210, between a first or deflected position shown in FIGS. 3, 4, 11 and 12, and a second or un-deflected position shown in FIGS. 2, 5, and 6. The centerline of the pin 210 thus defines an axis of rotation of the muzzle drop safety 200. The muzzle drop safety 200 is restrained from lateral movement, i.e., movement along the axis of the pin 210, by the chassis 26.

The muzzle drop safety 200 is biased in a clockwise direction from the perspective of FIGS. 2 and 5, toward its un-deflected position, by a spring 216. The spring 216 is positioned between a downward-facing surface of the arm 204, and a tab 217 that forms part of the bottom of the chassis 26, as can be seen in FIGS. 4, 6, 11, and 12. The stiffness, or spring constant of the spring 216 is selected to facilitate rotation of the muzzle drop safety 200 to its deflected position when the rifle 100 is dropped on its muzzle 118, while maintaining the muzzle drop safety 200 in its un-deflected position under normal operating conditions. The spring constant of the spring 216 can be, for example, about 1.5 to about 2.5 pounds per inch.

The body 41 of the trigger slide 22 has a substantially L-shaped notch 220 formed therein, on the side of the body 41 facing the muzzle drop safety 200. The notch 220 has an elongated first portion or slot 222, and an adjoining second portion 224, as can be seen in FIG. 12. The slot 222 extends substantially in the "x" direction.

As shown in FIGS. 11 and 12, the slot 222 is defined by a horizontally-oriented surface 226; a substantially parallel surface 228; and a curvilinear surface 231 that adjoins the surfaces 226, 228. The slot 222 has a height, or "z" dimension, that is slightly greater than the height of the arm 204 of the muzzle drop safety 200. This features permits the arm 204 to enter the slot 222 as described below. The second portion of the notch 220 is located at a bottom rearward corner of the body 41, and is defined by the surface 226, and a vertically-oriented surface 230.

Figure 6:
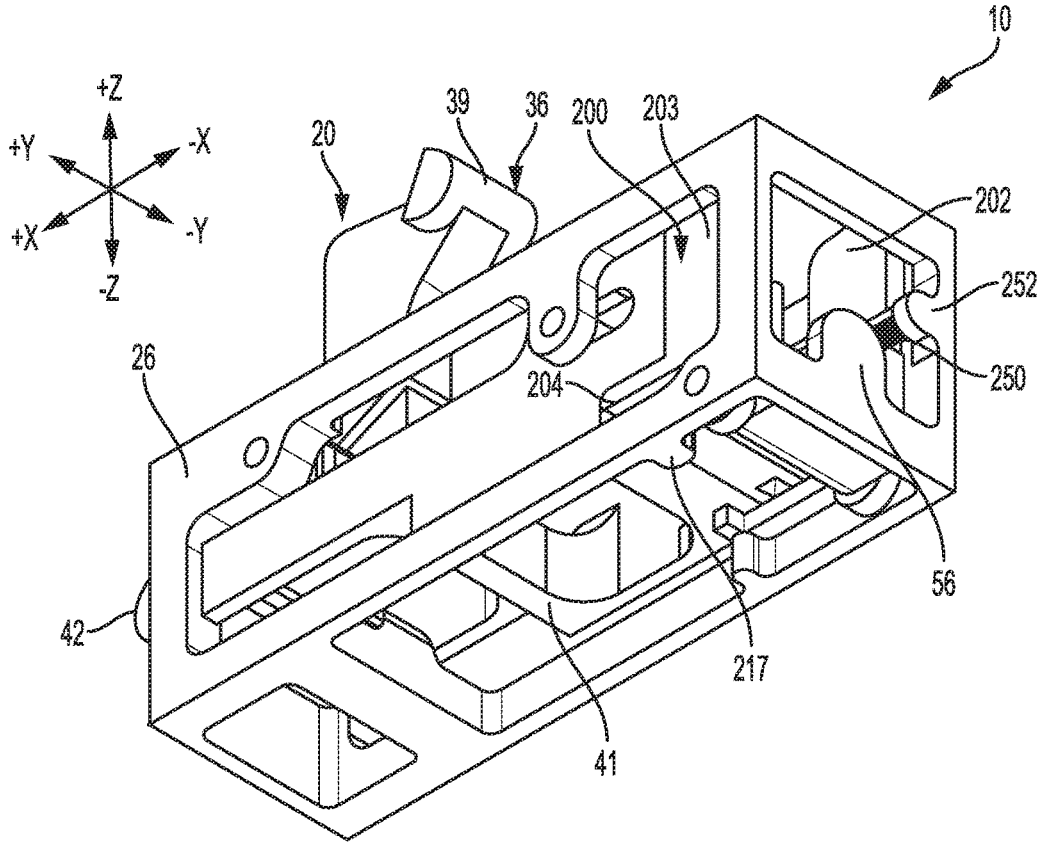
FIG. 6 is a left-rear perspective view of the trigger mechanism shown in FIGS. 3-5, with the hammer in the released position, the trigger slide in the pulled back position immediately after release of the hammer, and the first and second drop safeties in the un-deflected positions.

As can be seen in FIGS. 5 and 6, the arm 204 of the muzzle drop safety 200 is aligned with the slot 222 when the muzzle drop safety 200 is in its un-deflected position. The alignment of the arm 204 with the slot 222 permits the arm 204 to enter the slot 222 when the trigger slide 22 moves rearward, to its pulled back position, during the firing sequence for the firearm 10. Thus, the muzzle drop safety 200 does not interfere with the movement of the trigger slide 22 when the muzzle drop safety 200 is in its un-deflected position.

The muzzle drop safety 200, when in its deflected position, prevents the trigger slide 22 from moving toward its pulled back position, and thereby inhibits discharge of the rifle 100 under such conditions. The muzzle drop safety 200 is configured to rotate from its un-deflected position to its deflected position when the rifle 100 is dropped in an orientation such that its muzzle 118 strikes the ground before the rest of the rifle 100. In particular, the distribution of the mass of the muzzle drop safety 200 about its point of rotation, i.e., the centerline of the pin 210, is highly asymmetric, with nearly all of the mass, including all of the mass associated the relatively large body 203, residing above the pin 210, when the muzzle drop safety 200 is oriented as depicted in FIG. 15. Thus, the center of mass of the body 203, and the overall center of mass of the muzzle drop safety 200, are offset from the axis of rotation of the muzzle drop safety 200.

When the rifle 100 is in an orientation such that its muzzle 118 will impact the ground first, the rifle 100, including the trigger mechanism 10, has a downwardly-tilted, or nose-down attitude as shown in FIGS. 11 and 12. When the rifle 100 contacts the ground in such an orientation, the sudden deceleration of the rifle 100, in conjunction the momentum of the muzzle drop safety 200 and the highly asymmetric distribution of mass about its axis of rotation, cause the muzzle drop safety 200 to overcome the bias of the spring 216 and rotate in a counter-clockwise direction from the perspective of FIG. 3, to its deflected position.

Figure 3:
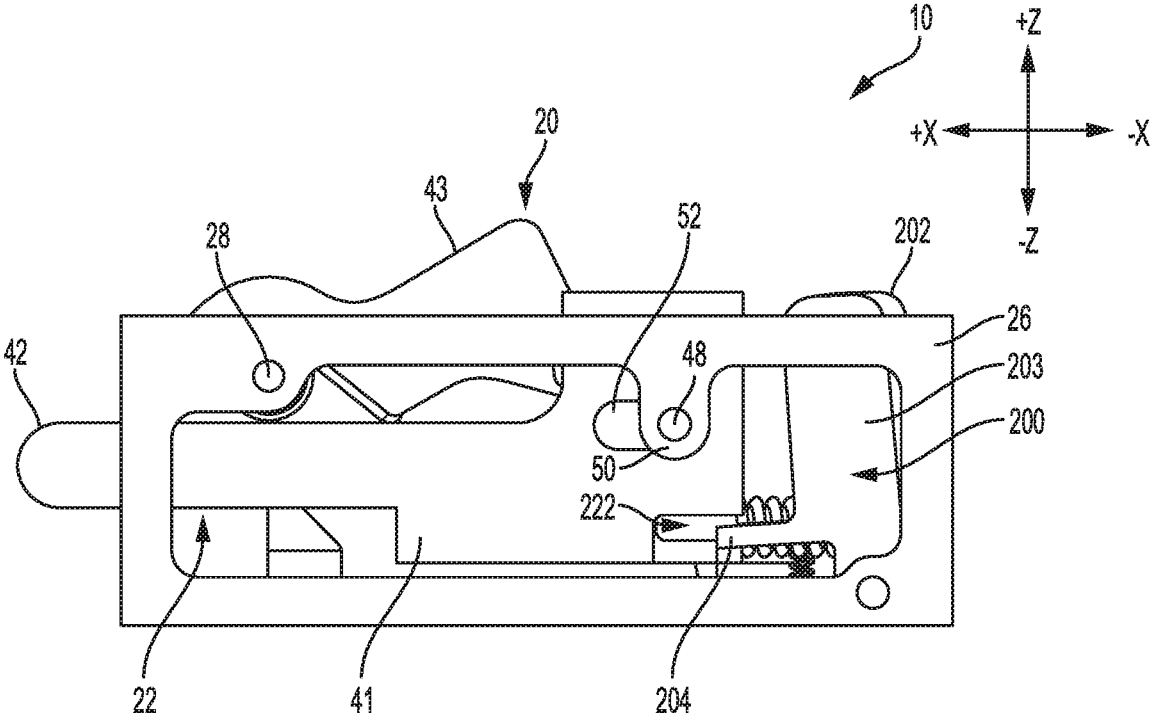
FIG. 3 is a left side view of the trigger mechanism shown in FIG. 2, with the hammer in a cocked position, the trigger slide in the not pulled position, the first drop safety in a deflected position, and the second drop safety in the un-deflected position.

The muzzle drop safety 200 inhibits discharge of the rifle 100 when the muzzle drop safety 200 is in its deflected position. In particular, a forward edge 229 of the arm 204 of the muzzle drop safety 200 partially aligns with, and is closely spaced from the surface 230 of the trigger slide 22 when the muzzle drop safety 200 is in its deflected position, as can be seen in FIGS. 3, 11, and 12. Interference between the forward edge 229 and the surface 230 will prevent rearward movement of the trigger slide 22 from its not pulled position to its pulled back position. Thus, in the event the specific orientation and velocity at which the muzzle 118 of the rifle 100 impacts the ground result in reactive forces sufficient to overcome the forward bias of the spring 53 on the trigger slide 22, the muzzle drop safety 200 can block substantial movement of the trigger slide 22 toward the pulled back position, which in turn can prevent initiation of the firing sequence.

Once the rifle 100 has come to rest after being dropped, the forward bias of the spring 53 on the trigger slide 22, and the bias of the spring 216 on the muzzle drop safety 200 will result in the return of the muzzle drop safety 200 to its un-deflected position, at which point the normal discharge sequence for the rifle 100 can be initiated.

The buttstock drop safety 202 operates in a manner similar to the muzzle drop safety 200. In particular, the buttstock drop safety 202 relies on an asymmetric distribution of mass about its axis of rotation, and its own momentum, to rotate into a position at which it blocks movement of the trigger slide 22 in the event the rifle 100 is dropped on its buttstock 107.

Figure 16:
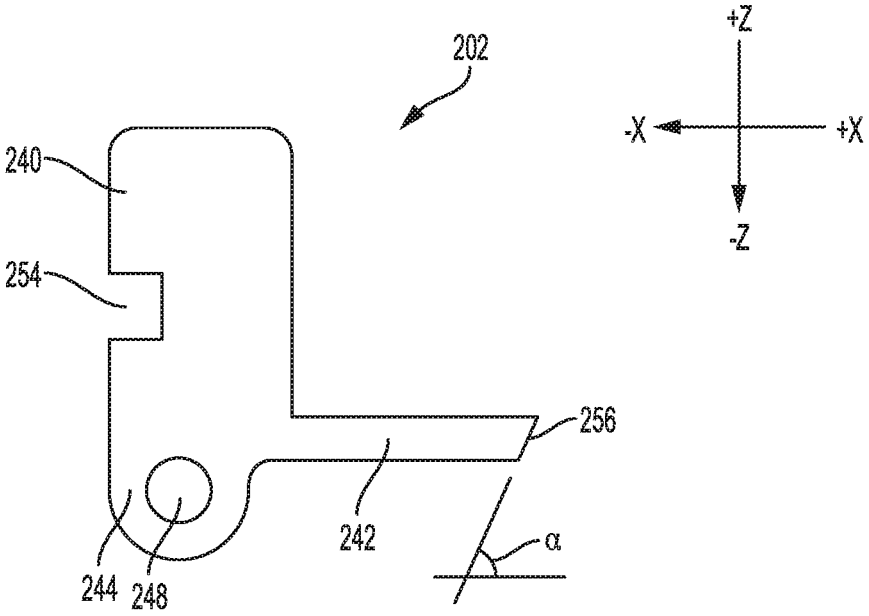
FIG. 16 is a side view of the second drop safety of the trigger mechanism of FIGS. 3-15.

The buttstock drop safety 202 comprises a body 240, an arm 242, and a mounting portion 244, as shown in FIG. 16. The arm 242 adjoins the body 240 and extends forwardly, in the "+x" direction, from the body 240. The mounting portion 244 adjoins the body 240 and extends downwardly, in the "−z" direction, from the body 240. The body 240 can have height or "z" dimension, for example, of about 0.61 inch to about 1.0 inch, such as about 0.7 inch to about 0.9 inch; a length or "x" dimension, for example, of about 0.4 inch to about 0.8 inch, such as about 0.5 inch to 0.7 inch; and a width or "y" dimension, for example, of about 0.8 inch to about 0.4 inch, such as about 0.1 inch to about 0.33 inch. The arm 242 can have a height, for example, of about 0.06 inch to about 0.15 inch.

As shown in FIGS. 13 and 14, the buttstock drop safety 202 is mounted proximate a lower rearward corner of the chassis 26, on the opposite side of the chassis 26 from the muzzle drop safety 200. The buttstock drop safety 202 is coupled to the chassis 26 by way of the pin 210 that also carries the muzzle drop safety 200.

The pin 210 extends through an aperture 248 formed in the mounting portion 244 of the buttstock drop safety 202. The diameter of aperture 248 is selected to permit the buttstock drop safety 202 to rotate freely in relation to the pin 210, between a first or deflected position shown in FIGS. 13, and 14, and an un-deflected position shown in FIGS. 4, 6, 8, and 10. The centerline of the pin 210 thus defines an axis of rotation of the buttstock drop safety 202. The buttstock drop safety 202 is restrained from lateral movement, i.e., movement along the axis of the pin 210, by the chassis 26.

Figure 4:
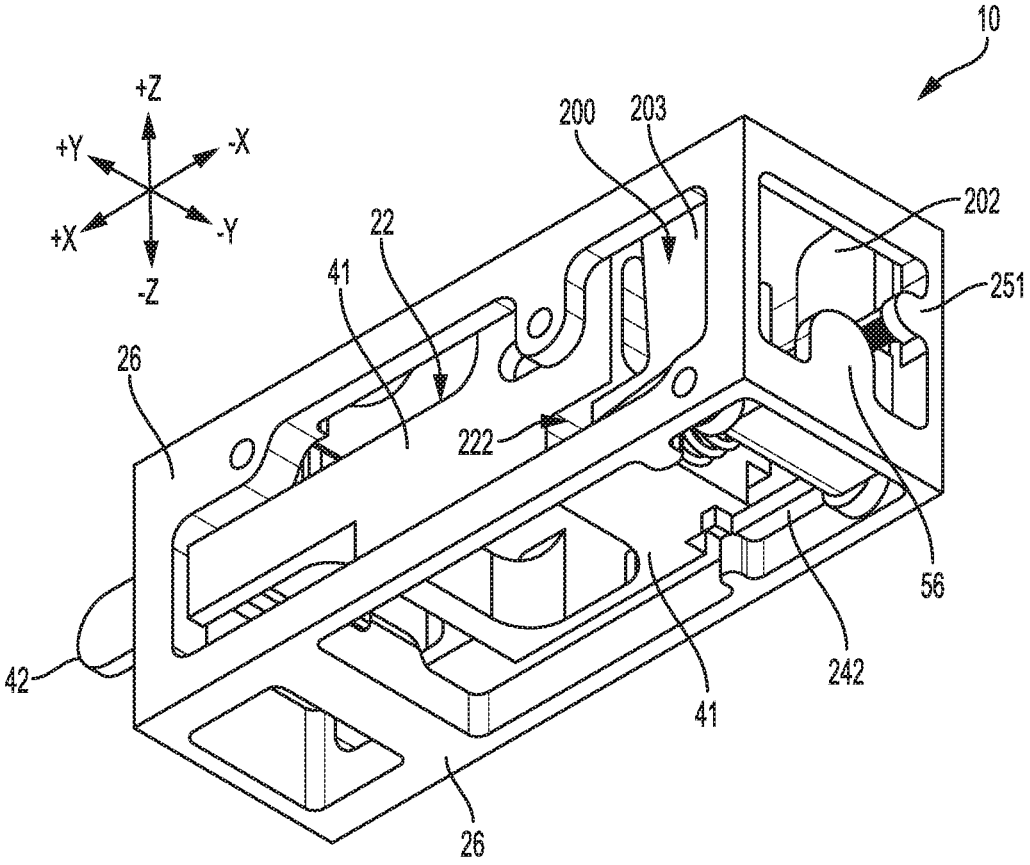
FIG. 4 is a left-rear perspective view of the trigger mechanism shown in FIGS. 2 and 3, with the hammer in the cocked position, the trigger slide in the not pulled position, the first drop safety in the deflected position, and the second drop safety in the un-deflected position.

The buttstock drop safety 202 is biased in a counter-clockwise direction from the perspective of FIG. 8, toward its un-deflected position. The bias is provided by a spring 250 positioned between the body 240, and a tab 251 forming part of the rearward end of the chassis 26, as can be seen in FIGS. 4, 8 and 10. The body 240 has a notch 254 formed therein to accommodate the spring 250, as shown for example in FIG. 16. The stiffness, or spring constant of the spring 250 is selected to facilitate rotation of the buttstock drop safety 202 to its deflected position when the rifle 100 is dropped on its buttstock 107, while maintaining the buttstock drop safety 202 in its un-deflected position under normal operating conditions. The spring constant of the spring 250 can be, for example, about 1 pound to about 2 pounds per inch.

The body 41 of the trigger slide 22 has a notch 258 formed therein, on the side of the body 41 facing the buttstock drop safety 202. The notch 258 is defined by a surface 252, a substantially parallel surface 253; and a curvilinear surface 255 that adjoins the surfaces 252, 253, as shown in FIGS. 13 and 14. The surface 252 is oriented at an angle "α" in relation to the lengthwise direction of the trigger mechanism 10. The angle α can be, for example, about 15 degrees to about 25 degrees.

The upper surface of the arm 242 of the buttstock drop safety 202 is lower than the surface 252 of the body 41 of the trigger slide 22, when the buttstock drop safety 202 is in its un-deflected position. Thus, the arm 242 remains entirely below the surface 252, and does not interfere with rearward movement of the trigger slide 22 as the trigger slide 22 moves from its not pulled position to its pulled back position. The buttstock drop safety 202, therefore, does not interfere with the movement of the trigger slide 22 when the buttstock drop safety 202 is in its un-deflected position.

The buttstock drop safety 202, when in its deflected position, prevents the trigger slide 22 from moving toward its pulled back position, and thereby inhibits discharge of the rifle 100 under such conditions. The buttstock drop safety 202 is configured to rotate from its un-deflected position to its deflected position when the rifle 100 is dropped in an orientation such that its buttstock 107 strikes the ground before the rest of the rifle 100. In particular, as in the muzzle drop safety 200, the distribution of the mass of the buttstock drop safety 202 about its point of rotation is highly asymmetric, with nearly all of the mass, including all of the mass associated the relatively large body 240, residing above the pin 210 when the buttstock drop safety 202 is oriented as depicted in FIG. 16. Thus, the overall center of mass of the buttstock drop safety 202, and the center of mass of the body 240 are offset from the axis of rotation of the buttstock drop safety 202.

When the rifle 100 is in an orientation such that its buttstock 107 will impact the ground first, the rifle 100, including the trigger mechanism 10, has a backwardly-tilted, or nose-high attitude as shown in FIGS. 13 and 14. When the rifle 100 contacts the ground in such an orientation, the sudden deceleration of the rifle 100, in conjunction the momentum of the buttstock drop safety 202 and the asymmetric distribution of mass about its axis of rotation, cause the muzzle drop safety 200 to overcome the bias of the spring 250 and rotate in a counter-clockwise direction from the perspective of FIGS. 13 and 14, to its deflected position.

The buttstock drop safety 202 inhibits discharge of the rifle 100 when the buttstock drop safety 202 is in its deflected position. In particular, a forward edge 256 of the arm 242 of the buttstock drop safety 202 partially aligns with, and is closely spaced from the surface 252 of the trigger slide 22 when the buttstock drop safety 202 is in its deflected position, as can be seen in FIG. 14. Interference between the forward edge 256 and the surface 252 will prevent rearward movement of the trigger slide 22 from its not pulled position to its pulled back position. Also, the forward edge 256 is angled in a manner similar to the surface 252, to encourage the forward edge 256 and the surface 252 to overlap and remain engaged immediately following impact of the rifle 100 with the ground.

Thus, in the event the specific orientation and velocity at which the buttstock 107 of the rifle 100 impacts the ground result in reactive forces sufficient to overcome the forward bias of the spring 53 on the trigger slide 22, the buttstock drop safety 202 can block substantial movement of the trigger slide 22 toward the pulled back position, which in turn will prevent initiation of the firing sequence.

Once the rifle 100 has come to rest after being dropped, the forward bias of the spring 53 on the trigger slide 22, and the bias of the spring 250 on the buttstock drop safety 202 will result in the return of the buttstock drop safety 202 to its un-deflected position, at which point the normal discharge sequence for the rifle 100 can be initiated.

Although the functionality of the muzzle drop safety 200 and the buttstock drop safety 202 have been discussed in relation to dropping the rifle 100 on its muzzle 118 and on its buttstock 107 respectively, it should be noted that the functionality of the muzzle drop safety 200 and the buttstock drop safety 202 are not limited to these specific events. The muzzle drop safety 200 and the buttstock drop safety 202 can prevent inadvertent discharge of the rifle 100 in other types of drops, and in other situations in which inertial forces and other types of external forces act on the rifle 100 in a manner that urges the trigger slide 22 toward its pulled back position.

Due in part to their relatively uncomplicated structure and kinematics, the muzzle drop safety 200 and the buttstock drop safety 202 are believed to provide a compact, reliable, and repeatable means for avoiding inadvertent and potentially life-threatening discharges of the rifle 100 when the firearm is dropped on its muzzle 118 or buttstock 107.

The muzzle drop safety 200 and the buttstock drop safety 202 can be used in trigger mechanisms other than the trigger mechanisms 10*a*, 10*b*. The muzzle drop safety 200 and the buttstock drop safety 202 can have particular benefit when used in the trigger mechanisms 10*a*, 10*b*, however, due to the above-described friction-reducing features that result in a relatively low trigger-pull weight for those mechanisms.

As used herein, the term "about" in reference to a numerical value means plus or minus 15 percent of the numerical value of the number with which it is being used.

We claim:

1. A trigger mechanism for a firearm, the trigger mechanism comprising:

a chassis;

a hammer mounted on the chassis and configured to rotate in relation to the chassis between a first position and a second position; and a trigger slide mounted on the chassis and configured to move linearly in relation to the chassis between a first position and a second position; wherein the trigger slide comprises a body, and a first rolling element mounted on the body; and the first rolling element is configured to engage and retain the hammer in the second position of the hammer when the trigger slide is in the first position of the trigger slide.

2. The trigger mechanism of claim 1, wherein the first rolling element is configured to disengage from the hammer when the trigger slide is in the second position of the trigger slide.

3. The trigger mechanism of claim 2, wherein the hammer has a substantially flat engagement surface and the first rolling element is configured to roll along the engagement surface when the trigger slide moves from the first to the second position of the trigger slide.

4. The trigger mechanism of claim 1, wherein the first rolling element comprises a pin, and a roller mounted on the pin and configured to rotate in relation to the pin and the body.

5. The trigger mechanism of claim 1, wherein the first rolling element comprises a pin roller configured to rotate in relation to the body.

6. The trigger mechanism of claim 1, further comprising a second rolling element mounted on the chassis, wherein the trigger slide is coupled to the chassis by way of the second rolling element.

7. The trigger mechanism of claim 6, wherein the second rolling element comprises a pin; a first and a second roller mounted on the pin and configured to rotate in relation to the pin and the chassis; and a spacer mounted on the pin between the first and the second rollers.

8. The trigger mechanism of claim 6, wherein the second rolling element comprises a pin roller configured to rotate in relation to the chassis.

9. The trigger mechanism of claim 1, further comprising a first drop safety comprising an arm, wherein the first drop safety is mounted on the chassis and is configured to rotate in relation to the chassis between a first position at which the arm blocks movement of the trigger slide from the first to the second position of the trigger slide; and a second position.

10. The trigger mechanism of claim 9, wherein the first drop safety further comprises a body connected to the arm; and the body of the first drop safety is offset from an axis of rotation of the first drop safety so that the axis of rotation does not pass through the body of the first drop safety.

11. The trigger mechanism of claim 10, wherein the first drop safety is biased toward the second position of the first drop safety; and the first drop safety is configured to rotate to the first position of the first drop safety when the firearm is dropped onto a contacting surface and strikes the contacting surface in a first predetermined orientation.

12. The trigger mechanism of claim 11, further comprising a second drop safety comprising an arm, and a body connected to the arm of the second drop safety, wherein:

the second first drop safety is mounted on the chassis and is configured to rotate in relation to the chassis between a first position at which the arm of the second drop safety blocks movement of the trigger slide from the first to the second position of the trigger slide; and a second position;

the body of the second drop safety is offset from an axis of rotation of the first drop safety so that the axis of rotation does not pass through the body of the second drop safety;

the second drop safety is biased toward the second position of the second drop safety; and the second drop safety is configured to rotate to the first position of the second drop safety when the firearm is dropped onto a contacting surface and strikes the contacting surface in a second predetermined orientation.

13. A firearm comprising the trigger mechanism of claim 1.

14. A trigger mechanism for a firearm, comprising:

a chassis;

a hammer mounted on the chassis and configured to rotate in relation to the chassis between a first position and a second position;

a trigger slide mounted on the chassis and configured to move linearly in relation to the chassis between a first position and a second position, and to engage and retain the hammer in the second position of the hammer when the trigger slide is in the first position of the trigger slide; and a first drop safety comprising an arm, and a body connected to the arm; wherein the first drop safety is mounted on the chassis and is configured to rotate in relation to the chassis between a first position at which the arm is configured to block movement of the trigger slide from the first to the second position of the trigger slide, and a second position; and wherein the body is offset from an axis of rotation of the first drop safety so that the axis of rotation does not pass through the body.

15. The trigger mechanism of claim 14, wherein the first drop safety is biased toward the second position of the first drop safety; and the first drop safety is configured to rotate to the first position of the first drop safety when the firearm is dropped onto a contacting surface and strikes the contacting surface in a first predetermined orientation.

16. The trigger mechanism of claim 15, wherein the trigger slide comprises a body having a notch formed therein; the notch is defined by at least one surface of the body of the trigger slide; and the body of the trigger slide is configured so that interfering contact between the arm and the surface when the arm is in the first position of the arm blocks movement of the trigger slide from the first to the second position of the trigger slide.

17. The trigger mechanism of claim 16, wherein the notch incudes a slot configured to receive the arm of the first drop safety when the first drop safety is in the second position of the first drop safety and the trigger slide moves from the first to the second position of the trigger slide.

18. The trigger mechanism of claim 16, wherein the arm of the first drop safety is located below the trigger slide when the first drop safety is in the second position of the first drop safety and the trigger slide moves from the first to the second position of the trigger slide.

19. The trigger mechanism of claim 15, further comprising a second drop safety comprising an arm, and a body connected to the arm of the second drop safety, wherein:

the second first drop safety is mounted on the chassis and is configured to rotate in relation to the chassis between a first position at which the arm of the second drop safety blocks movement of the trigger slide from the first to the second position of the trigger slide; and a second position;

the body of the second drop safety is offset from an axis of rotation of the second drop safety so that the axis of rotation does not pass through the body of the second drop safety;

the second drop safety is biased toward the second position of the second drop safety; and the second drop safety is configured to rotate to the first position of the second drop safety when the firearm is dropped onto a contacting surface and strikes the contacting surface in a second predetermined orientation.

20. A firearm comprising the trigger mechanism of claim 14.

* * * * *